US006233874B1

(12) United States Patent
Johnson, Jr.

(10) Patent No.: US 6,233,874 B1
(45) Date of Patent: May 22, 2001

(54) FREE-STANDING SAFETY GATE

(76) Inventor: Marvin B. Johnson, Jr., 25 Magnolia Dr., Newnan, GA (US) 30263

( * ) Notice: Subject to any disclaimer, the term of this patent is extended or adjusted under 35 U.S.C. 154(b) by 0 days.

(21) Appl. No.: 09/478,836

(22) Filed: Jan. 6, 2000

(51) Int. Cl.[7] ..... E05C 21/02
(52) U.S. Cl. ..... 49/465; 49/55
(58) Field of Search ..... 49/50, 55, 57, 49/463, 465

(56) References Cited

U.S. PATENT DOCUMENTS

| | | | | |
|---|---|---|---|---|
| 2,851,746 | * | 9/1958 | McPhaden | 49/55 X |
| 5,117,585 | * | 6/1992 | Andrisin | 49/57 X |
| 5,396,732 | * | 3/1995 | Andersen | 49/55 |
| 5,809,694 | * | 9/1998 | Postans | 49/57 |

FOREIGN PATENT DOCUMENTS

| | | | | |
|---|---|---|---|---|
| 2234281 | * | 1/1991 | (GB) | 49/57 |
| 2235945 | * | 3/1991 | (GB) | 49/57 |

* cited by examiner

*Primary Examiner*—Jerry Redman
(74) *Attorney, Agent, or Firm*—J. Gibson Semmes, Esq.

(57) ABSTRACT

A balanced free-standing juvenile safety gate characterized by its facile placement and displacement in a passageway wherein adjustably connected frame sections include a hinge frame and frame supporting platform with a hinge standpost being fixed to the platform; an extendible latch frame attached to the hinge frame with a latch handle atop said frame section, said latch handle having intermediate pivot connection to the frame section by pivoted connectors which in turn join the latch handle to a lever yoke, the lever yoke being connected at a lower end to a moveable bracket, whereby, upon closure of the latch handle transverse movement of bracket and pressure bar is forced into registry with one extreme of the passageway, against resistance of the standpost on an opposite extreme of the passageway; a caster supports the latch frame in extension of the hinge frame, during positions of passageway closure and opening.

5 Claims, 4 Drawing Sheets

FREE-STANDING SAFETY GATE

The invention is defined as a juvenile safety gate for portable installation between fixed extremes. It is characterized by its free-standing, swingable relationship to fixed passageway uprights, defining the passageway construction. Examples of its utility include positioning as a walk-through pressure gate, located inside hallways, doorways between rooms or opposed fence posts. The gate is universally extendible and retractable irrespective of even or uneven opposite extremes of the passageway, with latch control to delimit the extremes of pressure extension, relative to the lineal width of elements defining the passageway against which it presses.

SUMMARY OF INVENTION

The primary objective in the design of this gate is to eliminate the hazardous "trip bar" that is common to all other walk-through pressure gates. This is accomplished by creating a freestanding gate that supports itself in an upright position throughout an open and closing 180° arc. The gate frames, being lightweight aluminum, are stabilized by a steel platform on the hinge frame and a caster, which supports the latch frame during operation.

Pressure to secure the gate to the wall surfaces is applied by utilizing a scissors type over center latch system that exerts pressure to two vertical levers to which a pressure bar is attached allowing the pressure bar to pivot, thus compensating for any unevenness in the wall surface.

Gate width is maintained by two cup point set screws that engage the main gate frame when tightened. The width of the gate thus determines the amount of pressure applied to the pressure bar of the latch frame. A turnbuckle is incorporated in extension of a connector of the latch system that permits micro adjustment of the final pressure setting. Once the adjustments are made the gate can be removed from the passageway opening, set aside or stored, when not in use and further adjustment is not necessary when relocated.

In summary, a primary advantage of this gate over other pressure gates is the elimination of the hazardous trip bar. Secondary is the ease of relocating the gate without having to loosen any pressure pads. One simply releases the pressure by use of the latch, then moves the gate to any location desired, i.e., no trip bar, free standing.

DESCRIPTION OF PREFERRED EMBODIMENTS

Safety Gate 100 is composed of a hinge frame section 110 which is attached to a frame supporting platform 120. An extendible latch frame section 130 is adjustably set onto hinge frame section 110 for swinging movement in unison with the frame section. Both sections are set together, the latter being in extension of the former and the two together being locked against swinging movement by means of clamps and set screws. The free-standing characteristic of the gate is enhanced by a universally moveable caster 170, the caster and platform 120 combine to stabilize the frames.

Figure 1:
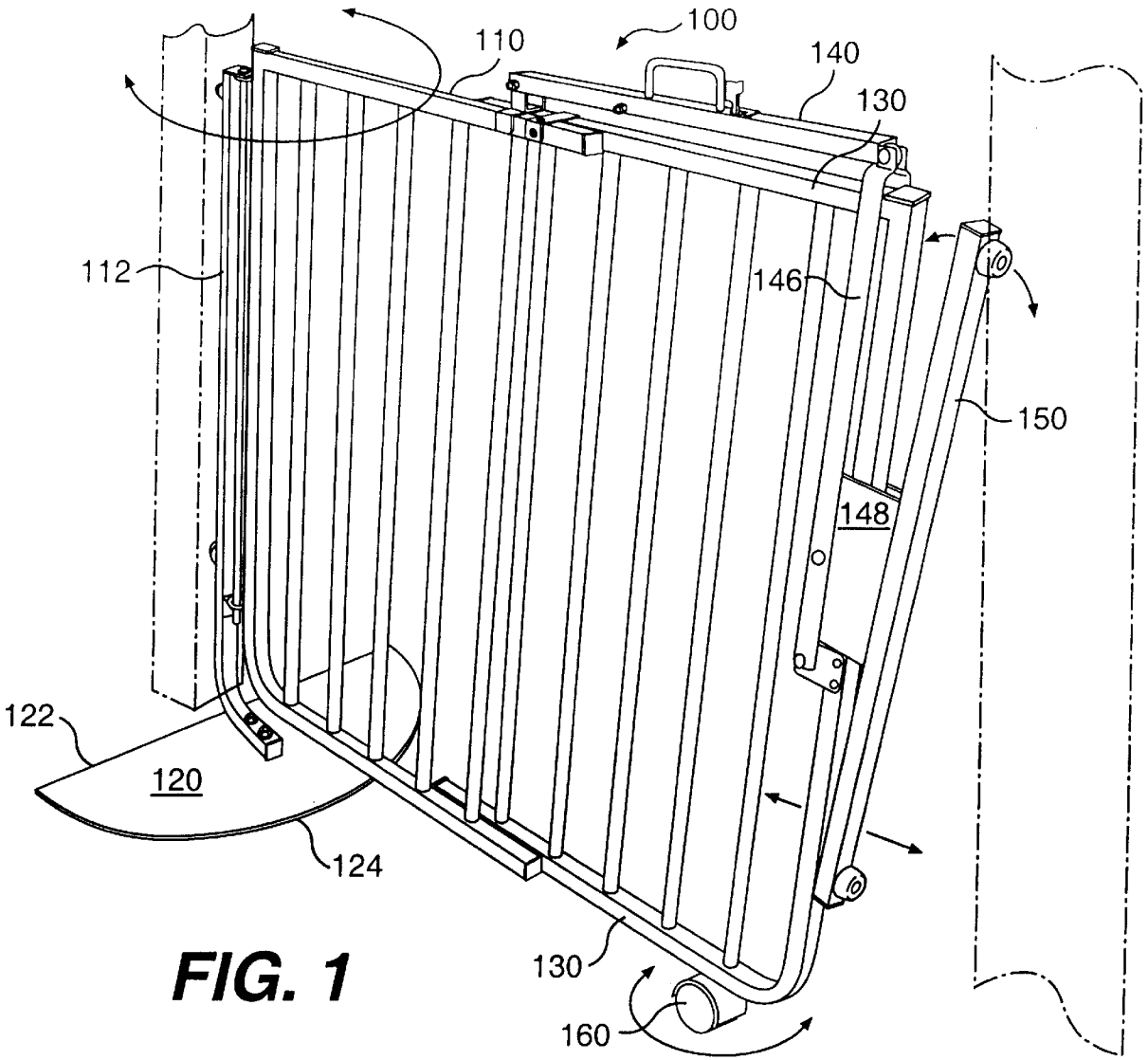
FIG. 1 is a perspective of the assembled invention, located between stanchions in phantom.
Figure 5:
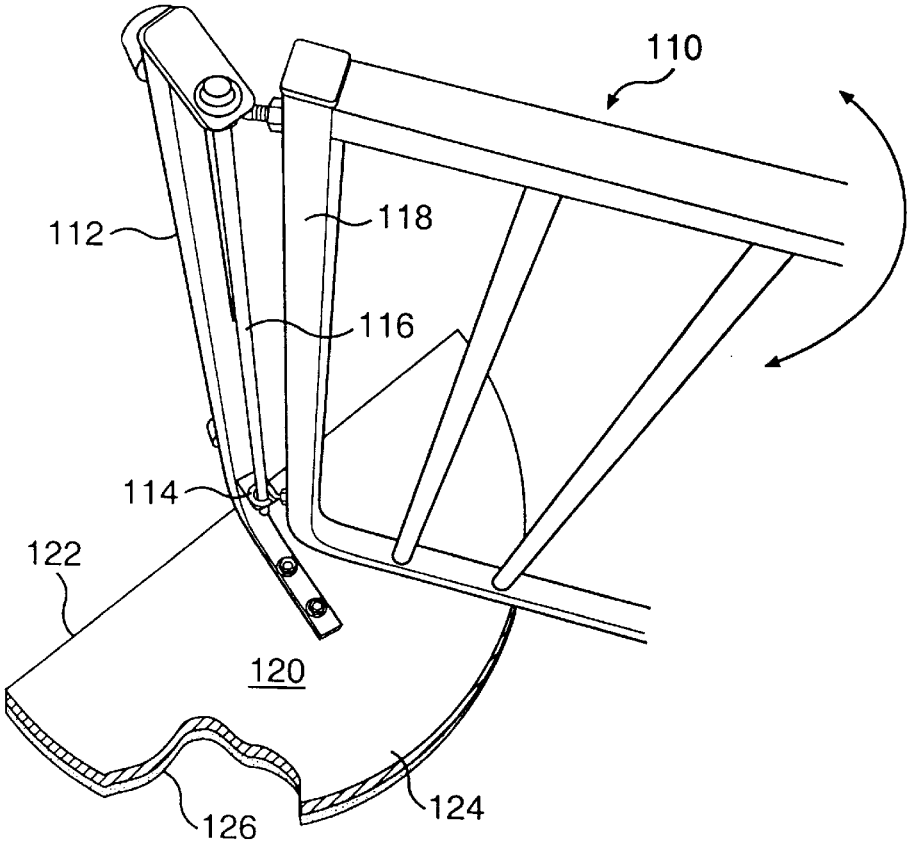
FIG. 5 depicts in perspective, the relative position of platform to standpost and hinged frame.

Referring to the drawings, in FIG. 1 is a perspective of the invention, the two gate sections being adjustably united and moveable together about a hinge which is fixed to the platform. The hinge consists of buffered standpost 112 with eyebolts 114, secured to the terminus 118 of rotatable hinge frame 110. A vertical hinge pin 116 is effectively spaced from the standpost and set within the eyebolts, thus connecting the hinge frame for arcuate movement about the combination standpost 112 and platform 120. Semi-circular platform 120 is of rigid construction having a straight edge 122 and an arcuate wing forming projection edge 124. See FIG. 5. The sub-surface of the platform 120 retains a tacky substance that serves to prevent lateral movement of the overall unit during its use. For example, not only will the substance protect the floor, but also it will prevent horizontal spinout of the platform should excessive force be applied to the hinge frame 110 when the gate is closed. Relative to the light frame sections 110 and 130, the platform is of sufficient mass and weight to provide a weighted anchor. The disposition of the caster, relative to the platform ensures that an imaginary top view triangulation is formed between the axis of the caster and lateral extremes of the platform, whereby vertical and horizontal stability to the gate is maintained, during opening and closing. Together with the in-line caster 160, rotational stability to the gate prevails about the hinge. To effect this stability, the overall weight distribution in a practical gate would be substantially as follows: total weight of the overall gate 12 lbs. the platform and standpost together being fabricated of steel; the gate frames and other assemblage are lighter by far, being fabricated of aluminum. Thus two-thirds of the overall weight is disposed at hinge extreme of the gate whereas the caster on the latch frame assembly supports only 3–4 lbs. of the overall weight, assuring free rolling mobility of the gate on carpet or wood floors.

Figure 4:
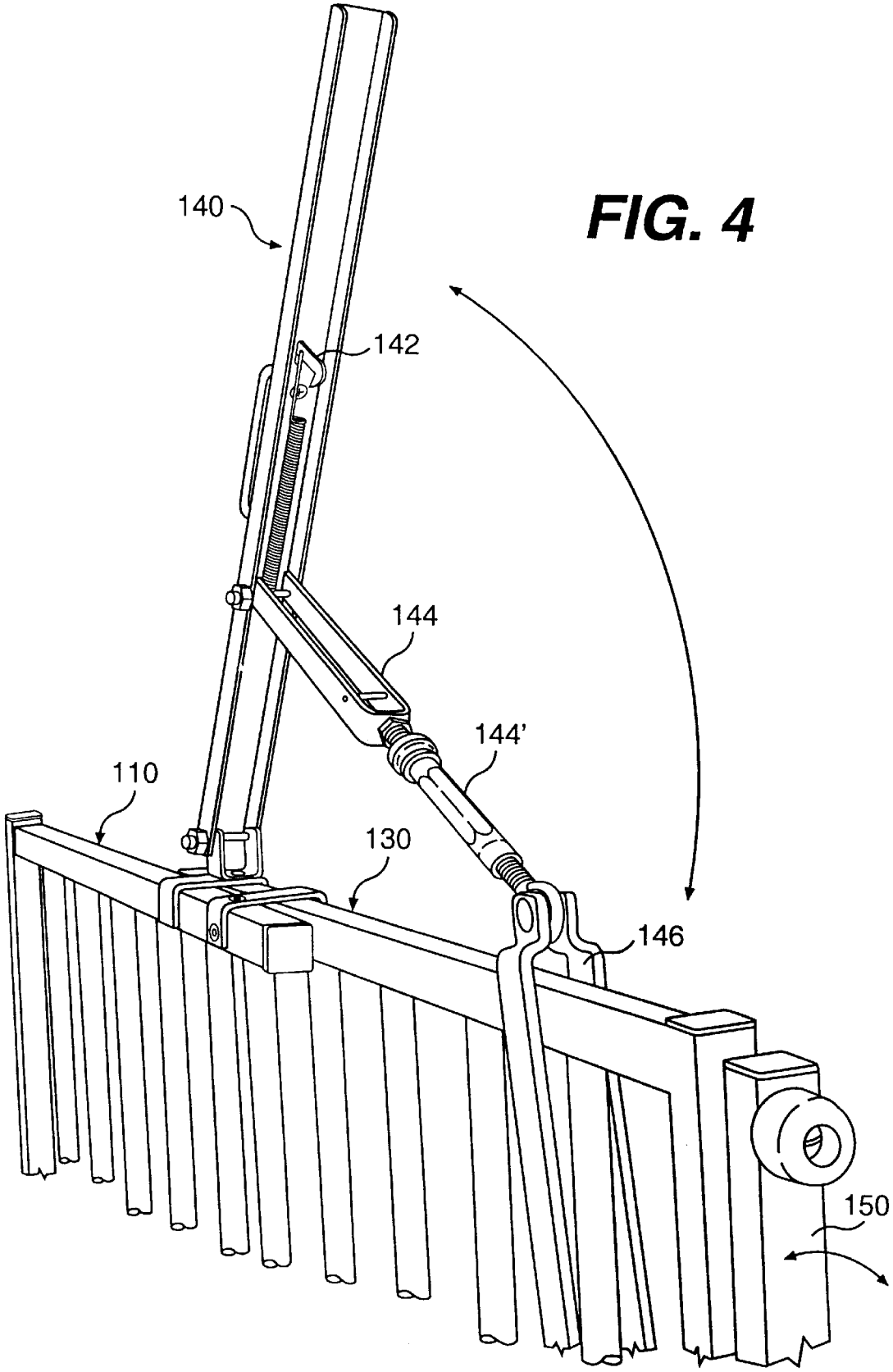
FIG. 4 depicts in perspective the respective frame sections, assembled with the latch handle unlocked.
Figure 4A:
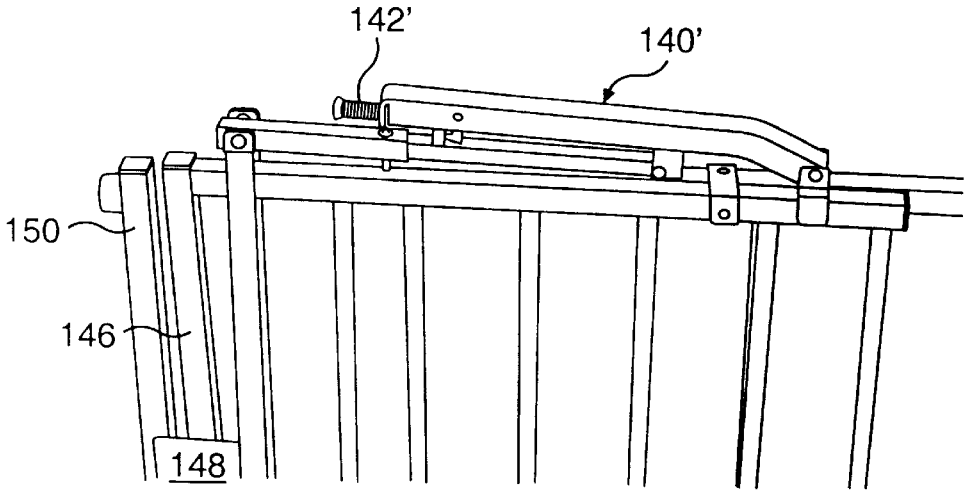
FIG. 4A depicts the locked position of latch handle, relative to the frames.

In FIG. 4A the modification 140' of latch frame assembly is shown with its pivoted handle. Here, the thumb latch 142' engages a telescoping connector 144", the latter being pivoted to the handle of the assembly. This modified connector comprises connecting tubes, adjustably secured together by a removable pin, the pin being adapted to adjustment holes through the inner tube to lengthen or shorten the overall connector. The latch itself is deactivated by the plunger which projects from the topmost element of the latch assembly, as will be apparent.

Figure 2:
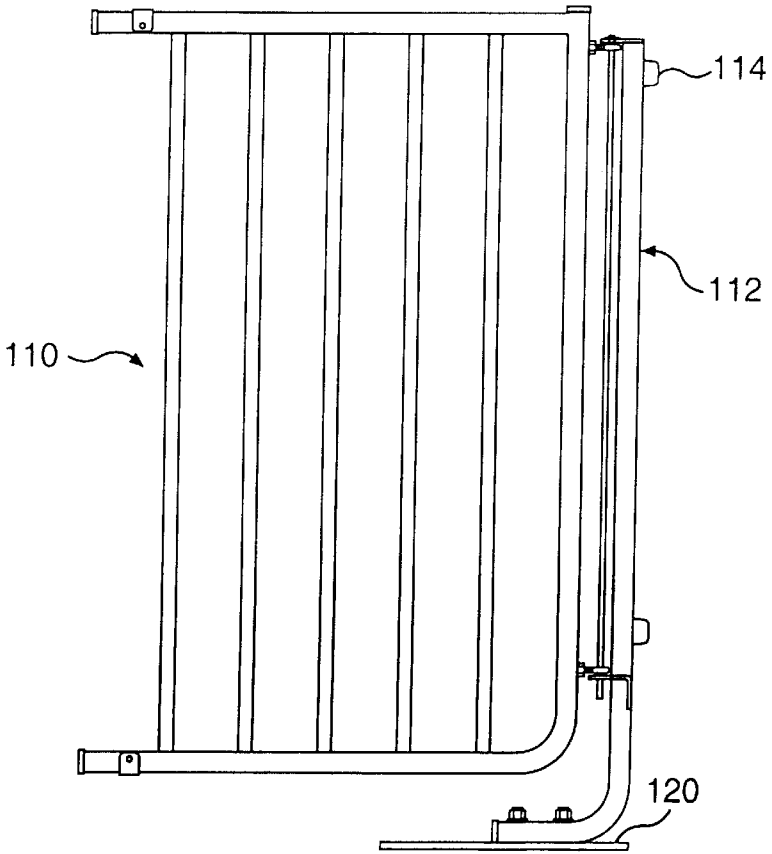
FIG. 2 depicts in elevation the right-hand latch frame section disassembled from the left-hand frame section.
Figure 3:
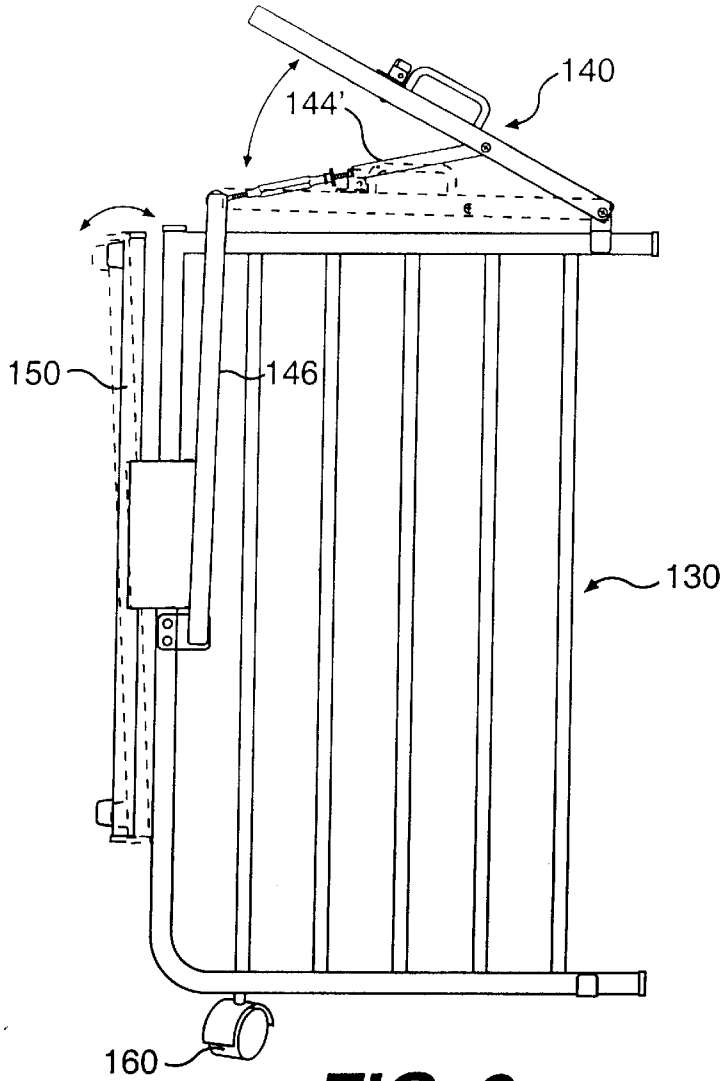
FIG. 3 depicts in elevation the left-hand latch frame section disassembled.

Referring to FIGS. 2 and 3, the respective frame sections 110–130 are shown in side elevation. Extendible latch frame 130 bears latch frame assembly 140, the latter consisting of a thumb latch 142, likewise shown in FIG. 4, in perspective. Latch 142 is pivoted to a clamp of the latch frame section 130. The thumb latch 142 being spring-loaded is pivoted, whereby its latching projection will engage a connector bar 144 of latch frame 130, once closed downwardly against it. Connection of the latch frame assembly 140 to yoke lever 146 is thus by means of connector 144 and turnbuckle adjustment 144', the specific arrangement being best shown in FIG. 4. The yoke 146 has latching connection, upon closure, with the pivoted connectors 144–144', the latter being connected to the upright end of the latch frame. The yoke 146 is pivoted at three points, namely: a moveable pivot at the upper extreme, a second pivot below the middle of the yoke, a third fixed pivot attached to a bracket 148 extending from the upright end bar, such that upon closure of the latch handle 140, the yoke will force the pivoted pressure bar 150 into registry with the right-hand extreme of building or wall construction. By contrast pressure bar 150 will retract upon disengagement of thumb latch 144 and raising of the handle in preparation for swinging the gate, to open the passageway. See FIGS. 1 and 2.

What is claimed is:

1. A free-standing juvenile safety gate for children characterized by facile placement and displacement in a passageway comprising adjustably connected frame sections, including a) a hinge frame (110) and frame supporting platform (120) with a hinge standpost (112) being fixed to the platform;

b) an extendible latch frame (130) attached to the hinge frame (110), with a latch handle (140) atop said latch frame (130), said latch handle having intermediate pivot connection to the latch frame by means of pivoted connectors (144–144') joining the latch handle to a lever yoke (146), said lever yoke being connected at a lower end to a moveable bracket (148), whereby, upon closure of the latch handle (140) transverse movement of said bracket and pressure bar (150) is forced into registry with one extreme of the passageway against resistance of a standpost on an opposite extreme of the passageway;

c) a caster (160) supporting the latch frame in extension of the hinge frame during positions of passageway closure and opening, the supporting by hinge and latch frames balancing the gate irrespective of its open and closed positioning in the passageway.

2. The juvenile safety gate of claim 1 wherein the hinge frame supporting platform (120) is configured with outstretched wings, its mass and weight being substantial, relative to the combined mass and weight of the attached latch frame and hinge frame, whereby the gate is balanced during respose or arcuate movement.

3. The juvenile gate of claim 2, including a tensioned latch (142) on the handle, said latch being likewise engageable with the connectors (144–144') to lock and release both the lever yoke (146) and bracket (148) into locking registry with the passageway.

4. The juvenile gate of claim 2 wherein a tensioned latch (140') engages an extendible telescope connector (144").

5. The juvenile gate of claims 1, 2, 3 or 4 wherein the disposition of the caster, relative to the platform ensures that an imaginary, top view triangulation is formed between the axis of the caster and at least one lateral extreme of the platform, whereby vertical and horizontal stability to the gate is maintained during opening and closing of the gate.

* * * * *